US007963896B2

(12) United States Patent
Nanna et al.

(10) Patent No.: US 7,963,896 B2
(45) Date of Patent: Jun. 21, 2011

(54) CHILD EXERCISE SEAT

(75) Inventors: Kyle Nanna, Westwood, MA (US); Jennifer M. Long, Providence, RI (US); John Kearney, North Attleboro, MA (US); Michael T. Kane, Fairport, NY (US)

(73) Assignee: Learning Curve Brands, Inc., Dyersville, IA (US)

( * ) Notice: Subject to any disclaimer, the term of this patent is extended or adjusted under 35 U.S.C. 154(b) by 0 days.

(21) Appl. No.: 12/596,329

(22) PCT Filed: Apr. 23, 2008

(86) PCT No.: PCT/US2008/061322

§ 371 (c)(1), (2), (4) Date: Oct. 16, 2009

(87) PCT Pub. No.: WO2008/131433

PCT Pub. Date: Oct. 30, 2008

(65) Prior Publication Data

US 2010/0062917 A1 Mar. 11, 2010

Related U.S. Application Data

(60) Provisional application No. 60/913,478, filed on Apr. 23, 2007.

(51) Int. Cl.
*A63B 26/00* (2006.01)

(52) U.S. Cl. ..... 482/142

(58) Field of Classification Search ..... 482/142, 482/27–35, 148, 66–69, 121; 434/335, 365, 434/308, 258; 446/226–227, 175, 397, 303; 273/374–375, 381; 119/707–708; 297/283.1, 297/118, 274; 248/561; 472/118; 135/67, 135/71, 84

See application file for complete search history.

(56) References Cited

U.S. PATENT DOCUMENTS

| | | | | |
|---|---|---|---|---|
| 4,371,206 | A | 2/1983 | Johnson, Jr. | |
| 4,795,151 | A * | 1/1989 | Mulcaster | 482/68 |
| 5,242,338 | A | 9/1993 | Hartdegen, III et al. | |
| 5,407,246 | A | 4/1995 | Meeker et al. | |
| 5,411,457 | A | 5/1995 | Hartdegen, III et al. | |
| 5,478,268 | A | 12/1995 | Au | |
| 5,518,475 | A * | 5/1996 | Garland | 482/68 |
| 6,203,395 | B1 | 3/2001 | McElhaney | |

(Continued)

FOREIGN PATENT DOCUMENTS

KR 10-2000-0029089 5/2000

(Continued)

OTHER PUBLICATIONS

Fisher Price Sensory Selections Bouncer, believed to be available before Oct. 16, 2009.

(Continued)

*Primary Examiner* — Lori Baker
(74) *Attorney, Agent, or Firm* — Michael Best & Friedrich LLP

(57) ABSTRACT

A child exercise device including a base assembly, a kick panel support assembly, a kick panel assembly, and a seat assembly. The base assembly includes a housing and a plurality of tracks oriented substantially parallel to each other. The kick panel support assembly is supported by the base and includes a plate coupled to the housing and a front panel coupled to the plate, the front panel having a plurality of apertures. The kick panel assembly is received by the plurality of apertures and includes a frame and a panel supported by the frame. The seat assembly includes a seat adapted to support the child and a plurality of wheels coupled to the seat and adapted to be received in one of the tracks in the base.

18 Claims, 11 Drawing Sheets

U.S. PATENT DOCUMENTS

| | | | | |
|---|---|---|---|---|
| 6,375,599 | B1 | 4/2002 | Brown | |
| 6,431,646 | B1 | 8/2002 | Longoria | |
| 6,592,425 | B2 | 7/2003 | Bapst et al. | |
| 6,676,475 | B1 * | 1/2004 | Henderson et al. | 446/227 |
| 7,062,146 | B2 | 6/2006 | Elias et al. | |
| 7,614,979 | B2 * | 11/2009 | Thomson et al. | 482/69 |
| 2002/0151415 | A1 * | 10/2002 | Hildebrandt et al. | 482/57 |
| 2003/0195095 | A1 * | 10/2003 | Endelman et al. | 482/142 |

FOREIGN PATENT DOCUMENTS

| | | |
|---|---|---|
| KR | 10-2005-0114609 | 12/2005 |
| KR | 10-2007-0012663 | 1/2007 |

OTHER PUBLICATIONS

Baby Einstein Rocker, believed to be available before Oct. 16, 2009.

Fisher Price Deluxe Papasan, believed to be available before Oct. 16, 2009.

Fisher Price Take-Along Swing, believed to be available before Oct. 16, 2009.

Carters Baby Bouncer Baby Vines Seat, believed to be available before Oct. 16, 2009.

PCT International Search Report and Written Opinion for International Application No. PCT/US2008/061322.

* cited by examiner

CHILD EXERCISE SEAT

RELATED APPLICATIONS

This application claims priority to U.S. Provisional Patent Application Ser. No. 60/913,478, filed on Apr. 23, 2007, titled CHILD EXERCISE SEAT, the entire contents of which are incorporated herein by reference.

BACKGROUND

Infants today spend a large percentage of their time in a sitting position in "seats" such as car seats, strollers, swings, bouncers, etc.

SUMMARY

In one embodiment, the invention provides a device featuring a child-activated inclined seat to help develop leg and core muscles and motor development. The seat can include a three-point harness that secures the child in the seat. The seat can include a seat pad having soft batting to cushion the child. The seat can also include a kick panel that the child uses to push against, thus generating a backward motion of the seat.

The seat is operable to move smoothly in a gliding motion by action of a plurality of supporting wheels. Gliding motion is the back and forth motion in generally the same plane of movement, whereas swinging motion is movement in an arc-like pattern.

A number of toys can be mounted on the kick panel or other areas of the seat. The toys can move, wobble, or create sounds in response to the child kicking the kick panel. The toys can be removed from the kick panel and reattached to the side of the seat for close baby entertainment. Other features of the seat can include motion switches that activate lights or sound effects ("SFX"). In addition, the seat can include a vibration unit located below the kick panel, and an adjustable stop such that the seat can be adjusted as the child grows.

In a different mode of the device, the kick panel can be removed and the device converted to a toddler glider chair.

In one embodiment, the invention provides a child exercise device comprising a base assembly, a kick panel support assembly, a kick panel assembly, and a seat assembly. The base assembly includes a housing, and a plurality of tracks oriented substantially parallel to each other. The kick panel support assembly is supported by the base and includes a plate coupled to the housing, and a front panel coupled to the plate, the front panel having a plurality of apertures. The kick panel assembly is received by the plurality of apertures and includes a frame, and a panel supported by the frame. The seat assembly includes a seat adapted to support the child and a plurality of wheels coupled to the seat and adapted to be received in one of the tracks in the base.

In another embodiment, the invention provides a child exercise device comprising a seat adapted to support the child; a base adapted to support the seat, the seat adapted to glide with respect to the base; a first assembly including a first portion coupled to the base and positioned between a bottom portion of the seat and an upper portion of the base, and a second portion extending from the first portion; and a second assembly coupled to the second portion of the first assembly, the second assembly oriented substantially perpendicular to the first portion of the first assembly.

In another embodiment, the invention provides a child exercise device comprising a base; a seat coupled to the base and oriented in a substantially horizontal plane, the seat adapted to support the child; and a kick panel coupled to the base, the seat adapted to glide along the horizontal plane when the child applies force to the kick panel.

Other aspects of the invention will become apparent by consideration of the detailed description and accompanying drawings.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items.

Although directional references, such as upper, lower, downward, upward, rearward, bottom, front, rear, etc., may be made herein in describing the drawings, these references are made relative to the drawings (as normally viewed) for convenience. These directions are not intended to be taken literally or limit the present invention in any form. In addition, terms such as "first," "second," and "third" are used herein for purposes of description and are not intended to indicate or imply relative importance or significance.

FIGS. 1-5 illustrate a child-activated exercise device 10 according to one embodiment of the present invention. The exercise device 10 includes features that help develop the leg and core muscles and motor skills of the child. Some of the various features include a soft seat, vibration, toys, and music with the benefit of child-activated kick and coast (gliding) motion allowing the development of the muscles and motor skills of the child while having fun. Other features of the exercise device 10 include the ability to adapt the device to the length or height of the growing child by making simple adjustments to the exercise device 10.

Figure 6:
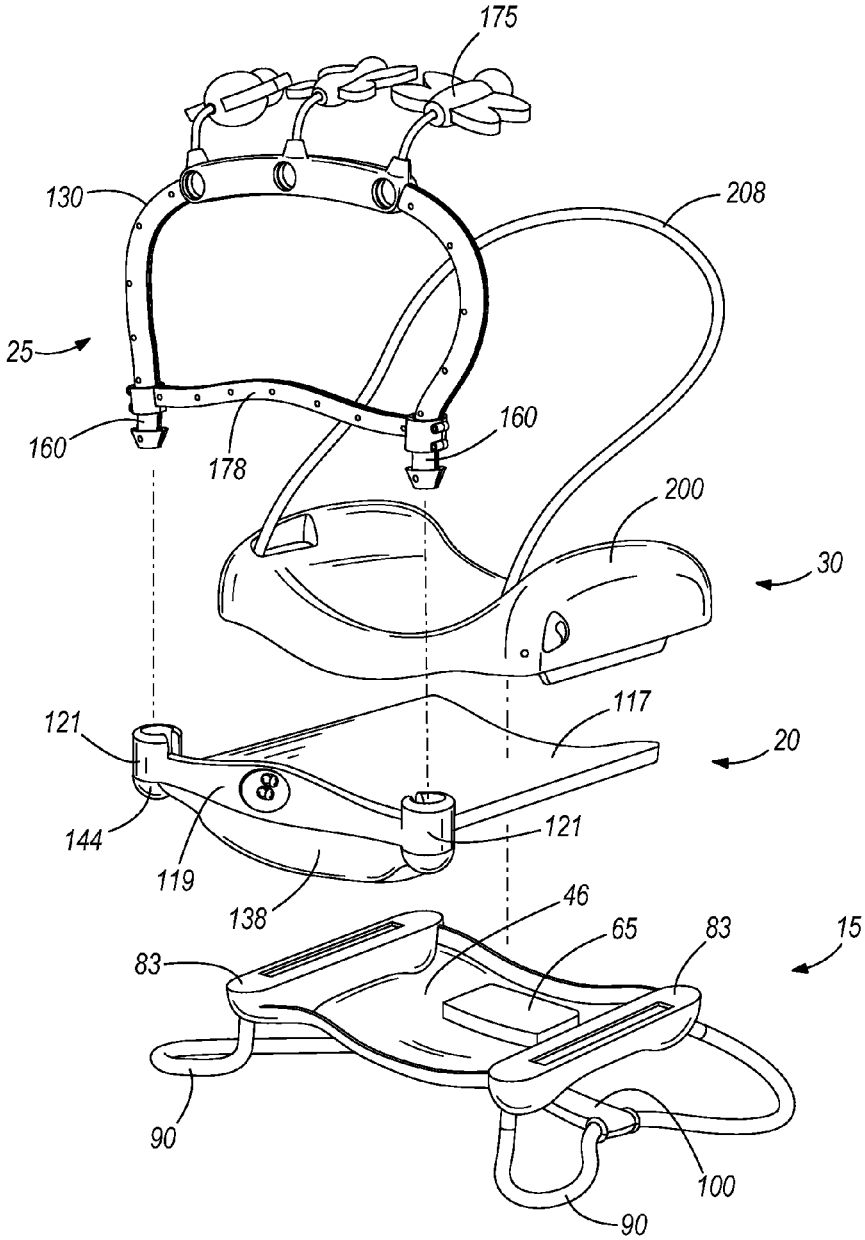
FIG. 6 is an exploded view of the child exercise device.

The exercise device 10 includes a plurality of assemblies as illustrated in FIG. 6 according to one embodiment of the present invention. More specifically, the exercise device 10 includes a base assembly 15, a kick panel support assembly 20, a kick panel assembly 25, a seat assembly 30, and a seat pad assembly 35 (shown in FIGS. 1 and 11). In operation, a force or kick applied to the kick panel assembly 25 while the child is seated in the seat assembly 30 will cause the seat assembly to move or glide away from the kick panel assembly 25. When the force is removed from the kick panel assembly 25, the seat assembly 30 can move toward the kick panel assembly 25.

Figure 7:
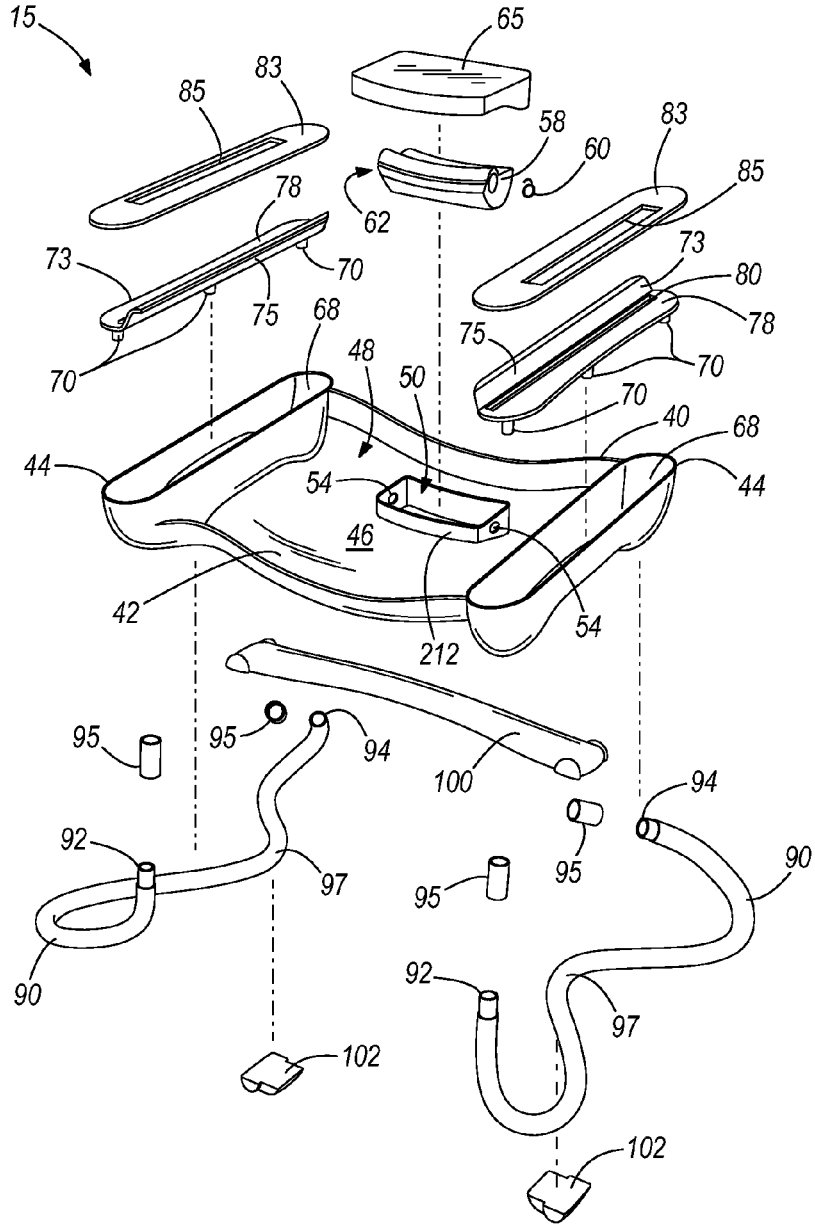
FIG. 7 is an exploded view of a base assembly of the child exercise device illustrated in FIG. 6.

With reference to FIGS. 6 and 7, the base assembly 15 includes a housing 40 having a central compartment 42 and two lateral compartments 44 adjacent the central compartment 42. The central compartment 42 includes a bottom wall 46 and two side walls 47 extending between the two lateral compartments 44 defining a recess 48. The central compartment 42 also includes an opening 50 through the bottom wall 46. The opening 50 is defined by a plurality of walls 52 protruding generally perpendicularly from the bottom wall 46. Two of the walls 52 generally oriented parallel to each other include an aperture 54. The opening 50 defined by the plurality of walls 52 is designed to receive an adjustment handle 58 and a spring 60 operable to actuate the adjustment handle 58. The adjustment handle 58 is supported in the opening 50 at least in part with a bar (not shown) extending between the apertures 54 and through a channel 62 of the adjustment handle 58 aligned with the apertures 54. A cover plate 65 is designed to engage the plurality of walls 52 to close the opening 50 from the recess 48.

Figure 1:
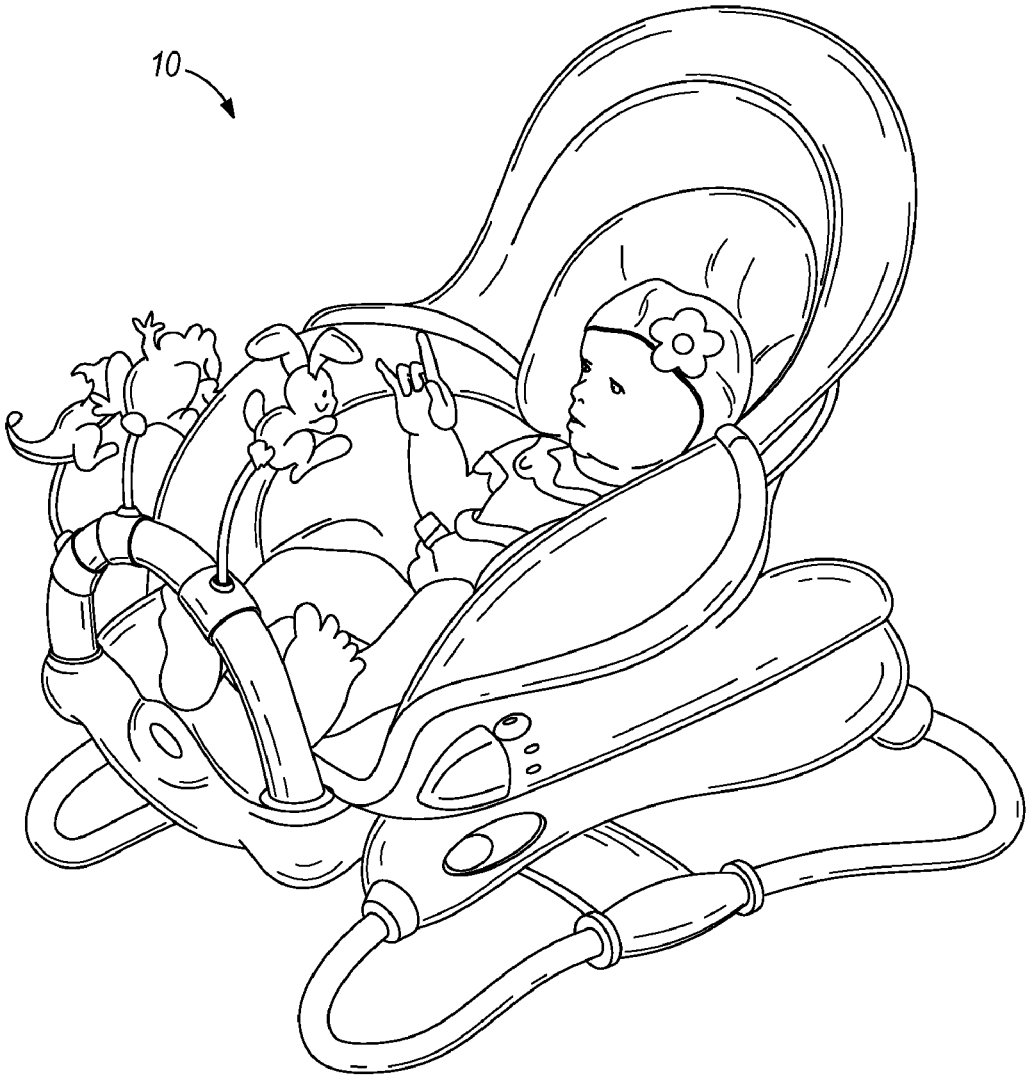
FIG. 1 is a perspective view of a child exercise device according to one embodiment of the present invention.

Each of the lateral compartments 44 includes a recess having an inner surface 68 with three upper receiving portions (not shown) adapted to be engaged by three corresponding pins 70 extending from a support plate 73. The support plate 73 includes a side wall 75 and a track 80 that generally extends the length of the support plate 73. The support plate 73 is adapted to support a guide plate 83, which includes an opening 85 extending longitudinally along the guide plate 83. The tracks 80 (only one shown in FIG. 7) are adapted to support one or more wheels of the seat assembly 30 when the seat assembly 30 is coupled to the base assembly 15, as shown in FIGS. 1-2 and discussed below.

With further reference to FIGS. 6 and 7, the base assembly 15 also includes two support legs 90. Each support leg 90 includes a first coupling end 92 and a second coupling end 94. The first coupling end 92 engages one end of the corresponding lateral compartment 44, and the second coupling end 94 engages the opposite end of the corresponding lateral compartment 44. The first coupling end 92 and the second coupling end 94 each engage the lateral compartment 44 with a leg connector 95 or coupling.

In the illustrated construction, each support leg 90 includes a center portion 97 oriented towards the opposite center portion 97. The center portions 97 are connected with a link 100. The link 100 is coupled to the center portions 97 with two link connectors 102 that help prevent the link 100 from slipping along and/or disconnecting from the support legs 90.

Figure 2:
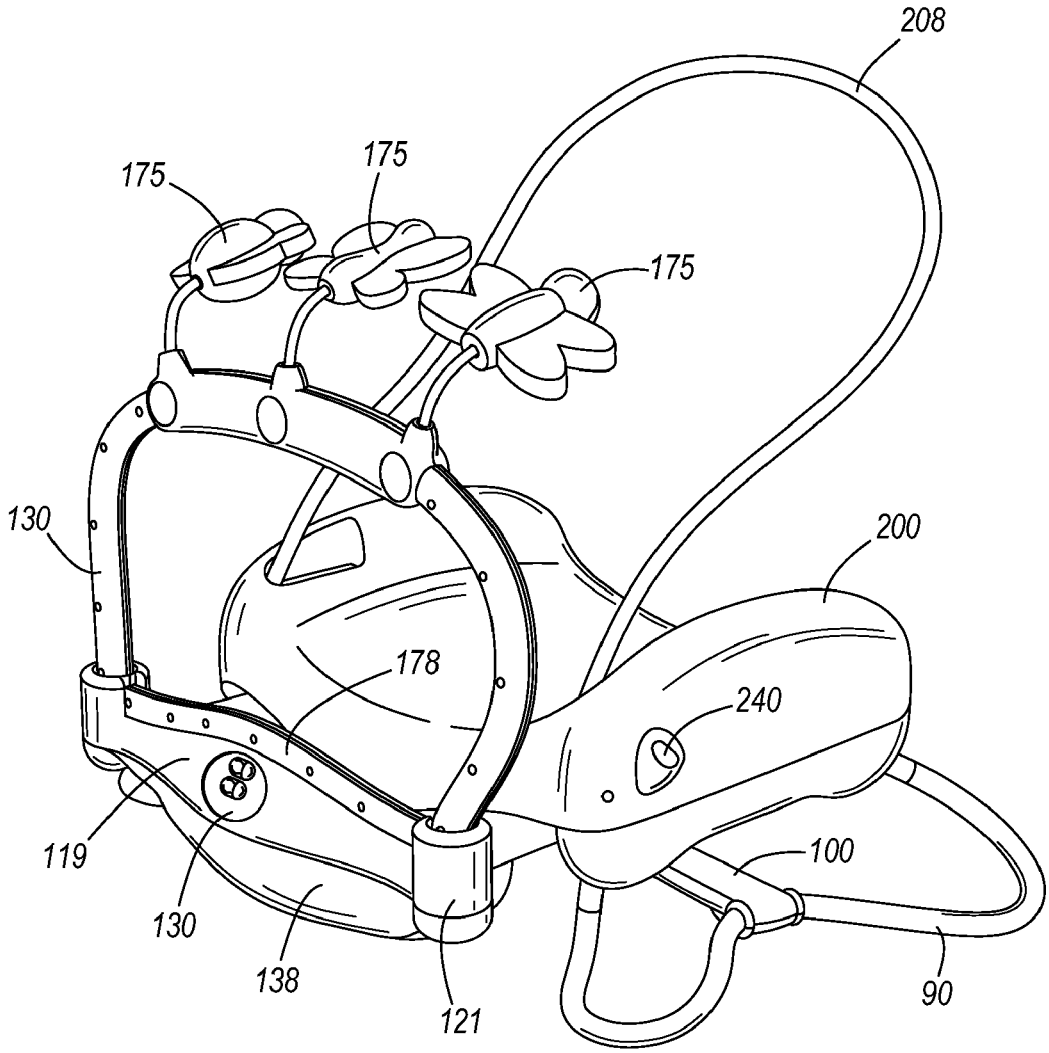
FIG. 2 is a perspective view of the child exercise device.
Figure 3:
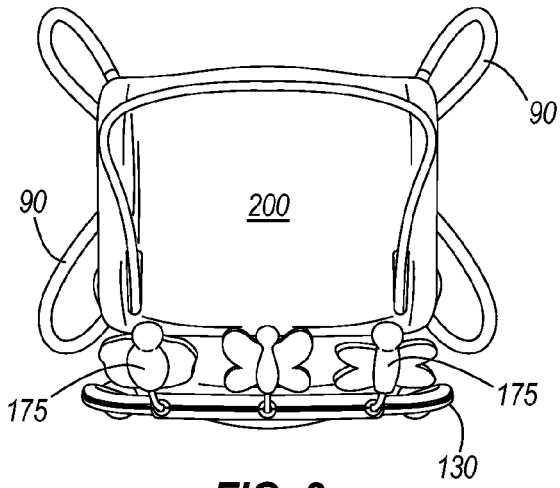
FIG. 3 is a top view of the child exercise device.
Figure 4:
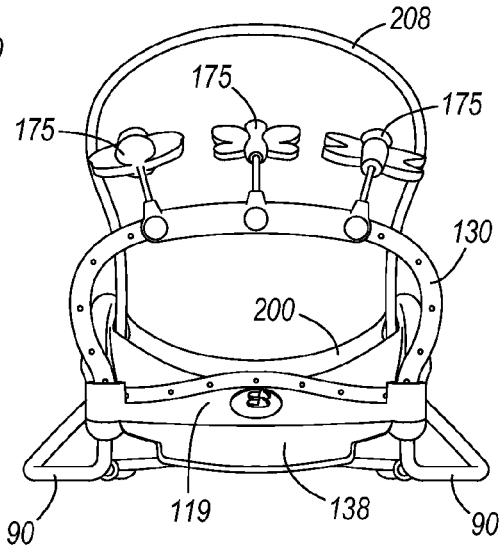
FIG. 4 is a front view of the child exercise device.
Figure 5:
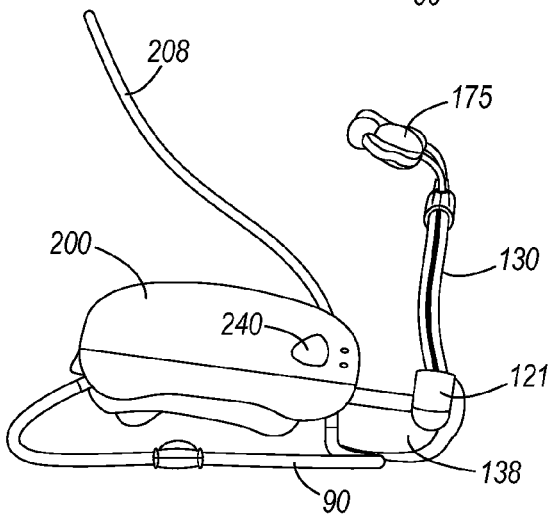
FIG. 5 is a side view of the child exercise device.
Figure 8:
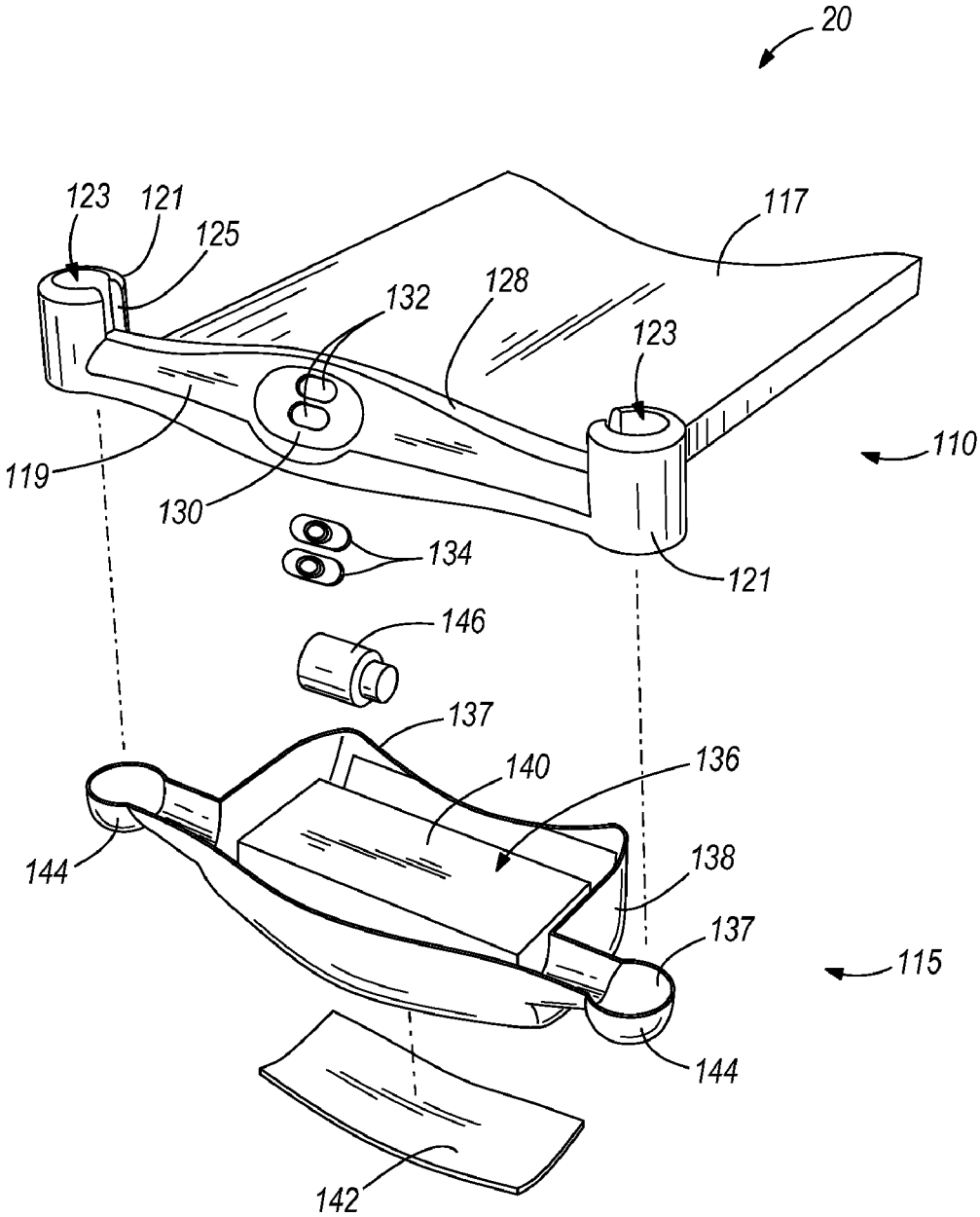
FIG. 8 is an exploded view of a kick panel support assembly of the child exercise device illustrated in FIG. 6.

As shown in FIG. 2, the kick panel support assembly 20 is supported by the base assembly 15. With reference to FIGS. 6 and 8, the kick panel support assembly 20 includes an upper portion 110 and a lower portion 115. The upper portion 110 includes an arcuate plate 117 integrally coupled to a front panel 119. The arcuate plate 117 is removably coupled to the housing 40 of the base assembly 15. The arcuate plate 117 includes at least one snap assembly to secure the arcuate plate 117 to the housing 40 while in use. The snap assembly can include a plurality of connection points to adjust the position of the arcuate plate 117 to accommodate for child growth, at least in part on the child's length or height.

The front panel 119 includes two ports 121 each with an aperture 123 and a groove 125 formed along at least a portion of the aperture 123. The apertures 123 and grooves 125 are adapted to receive male portions of the kick panel assembly 25 (discussed below). The front panel 119 includes an upper surface 128 extending between the ports 121 and is adapted to contact a retainer bar 178 of the kick panel assembly 25, as shown in FIG. 2. The front panel 119 also includes a control module 130 with apertures 132 designed to receive buttons 134. The illustrated construction shows two apertures 132 and two corresponding buttons 134. However, the front panel 119 can include a different number of apertures 132 and buttons 134 based on desired features of the exercise device 10. For example, the buttons 134 can control various sound and/or play modes, volume, lights, and motion.

The bottom portion 115 of the kick panel support assembly 20 includes a housing 138 having a plurality of walls 137 and defining a recess 136. The recess 136 supports a housing 140, and two extending cup sections 144 extending from opposite sides of the housing 138. The housing 140 generally supports a power source, such as a battery (not shown), that can be accessed from the housing 138 from a lower section of the bottom portion 115. The bottom portion 115 also includes a door plate 142 coupled to the lower section to enclose the battery within the housing 140. Also supported within the recess 136 is a motor 146 electrically coupled to the battery and to at least one of the buttons 134. The motor 146 is operable to impart motion, such as vibration to one or more components of the exercise device 10 upon actuation of at least one button 134 or other mechanism. The housing 138 also can support a processor, sound chip, and/or a speaker for generating sounds and/or music.

In some constructions, the buttons 134 can be coupled to switches that can activate one or more lights, such as LEDs or the processor or sound chip also powered by the battery in the housing 140. As shown in FIGS. 1, 2 and 6, the bottom portion 115 is coupled to the top portion 110 such that each of the extending cup sections 144 is substantially vertically aligned with one corresponding port 121. A rear wall 137 defining the housing 138 extends to a middle section of the arcuate plate 117.

Figure 9:
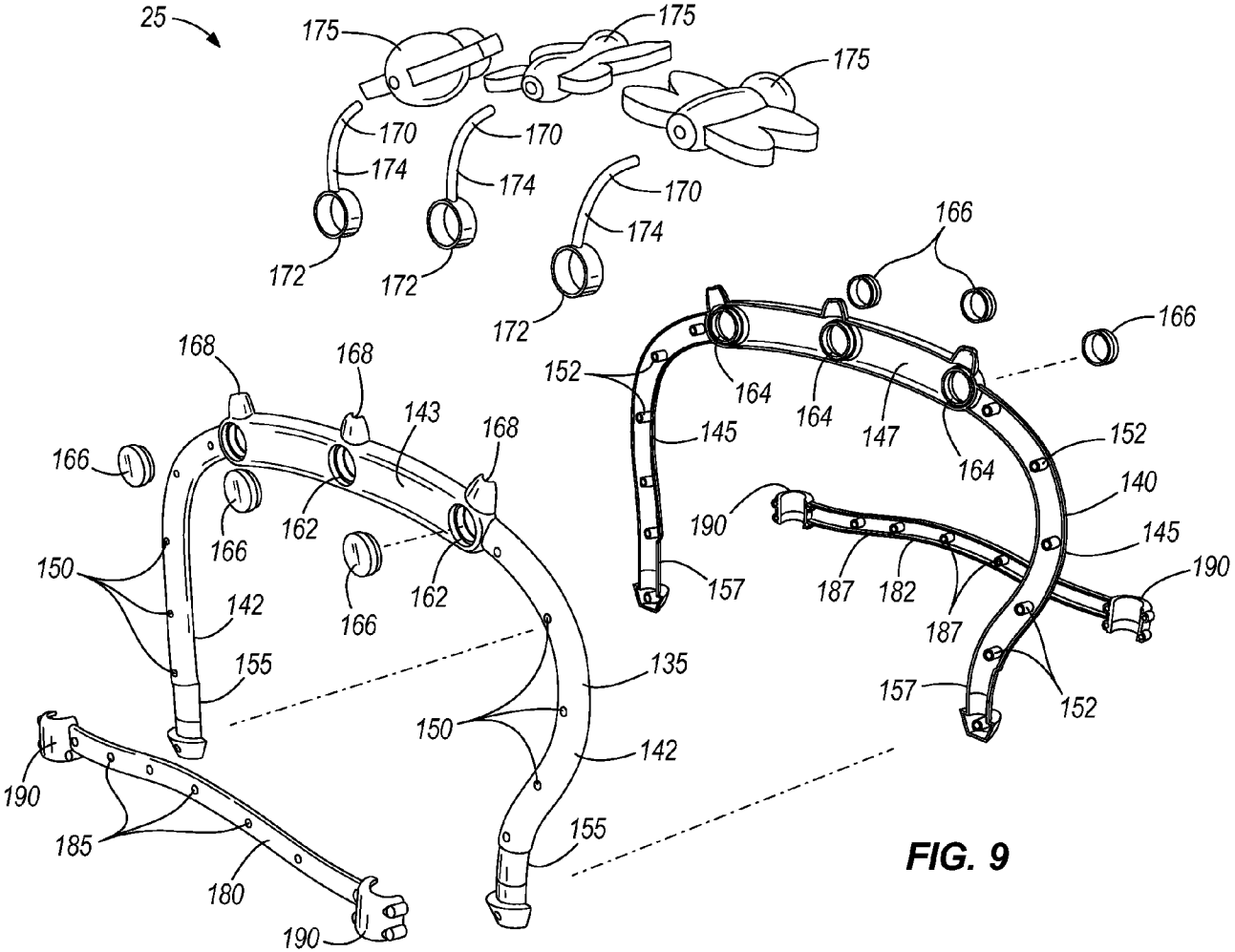
FIG. 9 is an exploded view of a kick panel assembly of the child exercise device illustrated in FIG. 6.

With reference to FIGS. 6 and 9, the kick panel assembly 25 includes a generally U-shaped frame assembly 133 having a front portion 135 and a rear portion 140. The front portion 135 includes vertical portions 142 coupled by a horizontal portion 143, and the rear portion 140 includes vertical portions 145 coupled by a horizontal portion 147. The vertical portions 142 include a number of fittings or apertures 150 designed to receive a number of corresponding pins 152 protruding from the rear vertical portions 145. Each front vertical portion 142 also includes a front coupling portion 155 that aligns with a rear coupling portion 157 defined on each vertical portion 145. When the front portion 135 is coupled to the back portion 140, the kick panel assembly 25 forms two male couplings 160.

The forward horizontal portion 143 includes a plurality of fittings or apertures 162 generally aligned with corresponding apertures 164 defined in the rear horizontal portion 147. The apertures 162 and 164 define a generally greater diameter than the diameter defined by apertures 150 of the vertical portions 142. A cap 166 can fit within the apertures 162, 164. The horizontal portions 143 and 147 also include vertically oriented extensions 168. When the front portion 135 is coupled to the back portion 140, the apertures 162 and 164 are adapted to support a portion of a flexible spring or rod 170. More specifically, the kick panel assembly 25 includes a number of flexible rods 170 corresponding to the number of supporting apertures 162, 164. Each flexible rod 170 includes a ring 172 at one end, and a flexible extension 174 at the opposite end. When the front portion 135 is coupled to the back portion 140, the ring 172 of each flexible rod 170 snuggly fits between extending walls of the apertures 162 and 164, and the extensions 168 form a vertically oriented aperture supporting a portion of the flexible extension 174 near the ring 172. At the free end of the flexible extensions 174 (the end opposite to the ring 172), each flexible rod 170 is coupled to a character or toy 175. The toy(s) 175 can move and/or vibrate on its own and/or when a force is applied to the kick panel assembly 25. In addition, the toy(s) 175, horizontal portions 143, 147, and/or the vertical portions 142, 145 can include a light source such as a LED, which can be activated, for example, when a force is applied to the kick panel assembly 25.

With further reference to FIGS. 6 and 9, the kick panel assembly 25 also includes a retainer bar 178 extending between the vertical portions 142 and 145 of the frame. The retainer bar 178 includes a front portion 180 and a back portion 182. The front portion 180 includes a number of fittings or apertures 185 adapted to receive a corresponding number of pins 187 protruding from the back portion 182. The front portion 180 and the back portion 182 each include two curved coupling portions 190 at opposite ends thereof. Each of the curved portions 190 is adapted to fit around or to be coupled to one corresponding coupling portion 155 and 157. When the front portion 135 and the back portion 140 of the frame are coupled together, corresponding curved portions 190 of the front portion 180 and back portion 182 clamp onto at least a section of the smaller diameter sections 160. As a result, the retainer bar 178 helps prevent relative motion or bending of the U-shaped kick bar 130 in an axial direction substantially parallel to the retainer bar 178, for example. The retainer bar 178 also helps prevent substantial relative movement or bending of the U-shaped frame assembly 133 in other directions.

Figure 11:
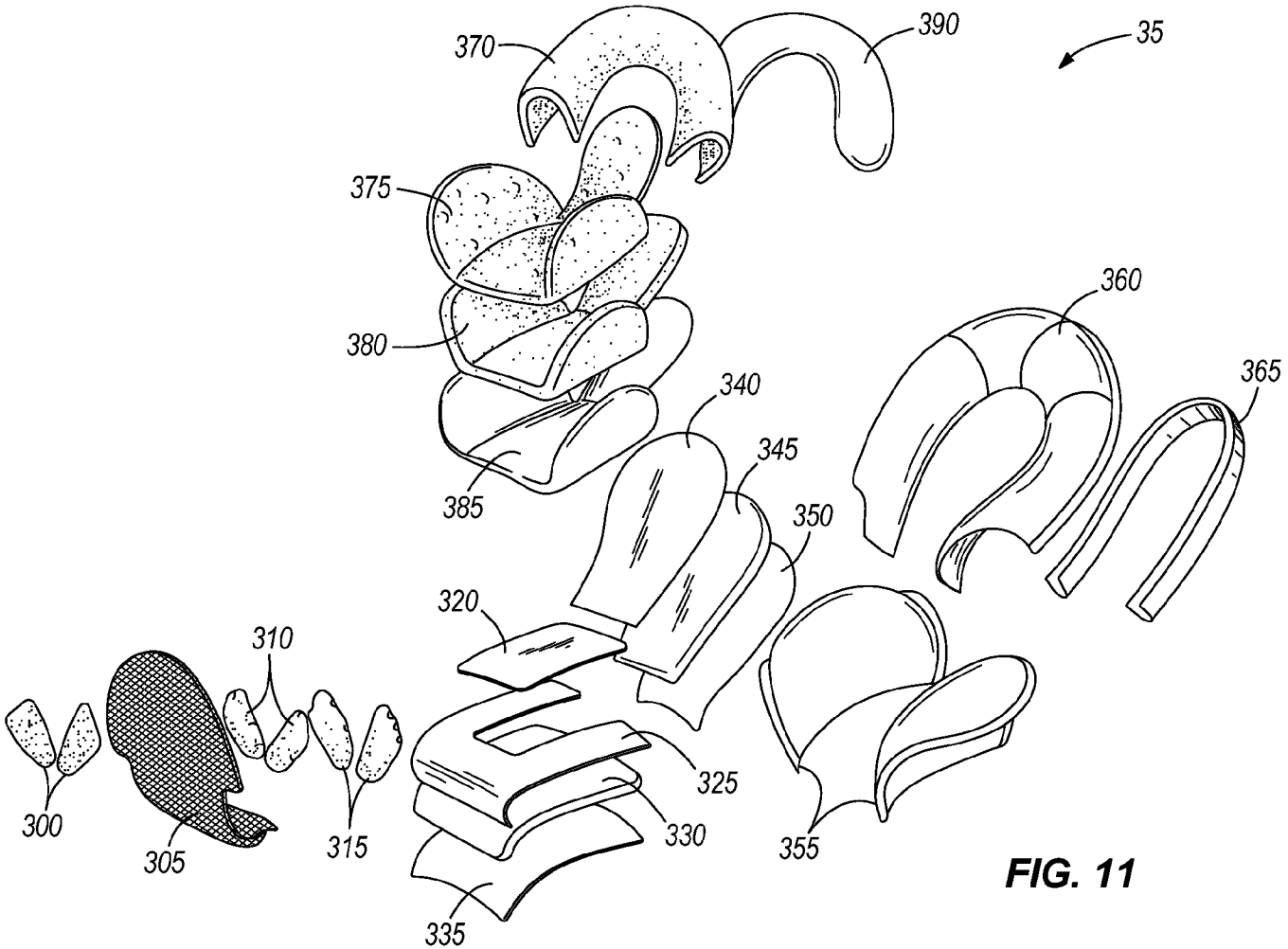
FIG. 11 is an exploded view of a seat pad assembly of the child exercise device.

The kick panel assembly 25 also includes a panel 305 illustrated in FIG. 11. The panel 305 can comprise mesh, fabric, an acrylic plate and/or other suitable generally flat material. The panel 305 can include a sensor adapted to trigger sounds, lights, and/or motion when contact is made with the panel 305 and/or a force at a predetermined threshold is exerted on the panel 305. For example, vibration of the seat assembly can be triggered by an exertion of force on the panel 305. The motion can be imparted to one or more suitable components of the device 10 such as with the toy(s) 175. In addition, the motion can be randomly selected to occur one or more of the suitable components for each triggering event.

Figure 10:
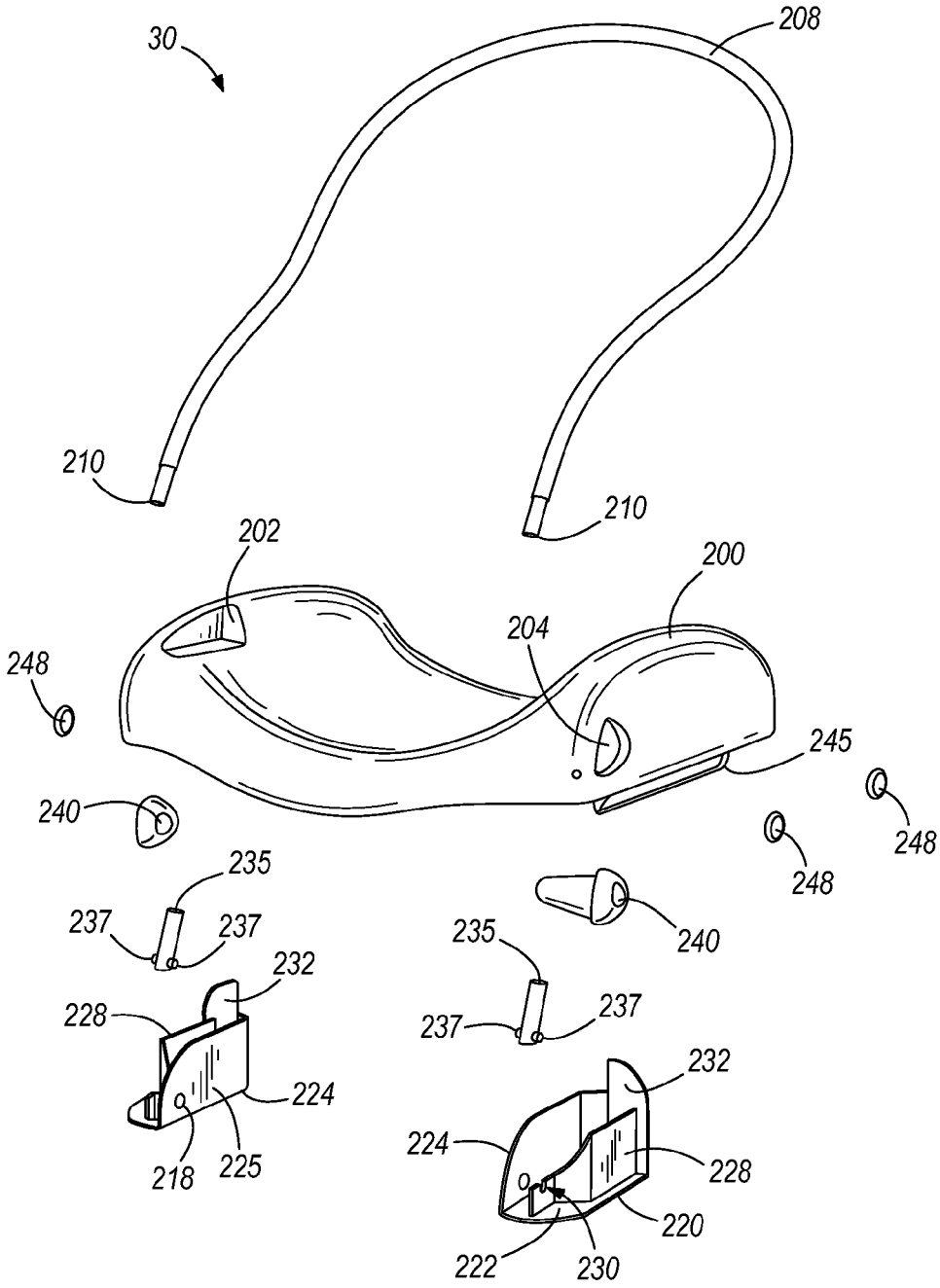
FIG. 10 is an exploded view of a seat assembly of the child exercise device illustrated in FIG. 6.

With reference to FIGS. 6 and 10, the seat assembly 30 includes a seat housing 200 having a plurality of recesses 202 and 204 (only one of each shown in FIGS. 6 and 10). The seat assembly 30 also includes a frame 208 generally U-shaped and including two coupling ends 210. The frame 208 is coupled to the housing 200 via the coupling ends 210 engaged in a corresponding recess 202. The frame 208 is generally detachably coupled at an angle with respect to the seat housing 200. However, other configurations are possible.

The seat assembly 30 also includes a first retainer 218 and a second retainer 220 coupled to opposite sides of the seat housing 200. Each of the first retainer 218 and the second retainer 220 includes a base 222 coupled to a first vertical wall 224 with a receiving aperture 225, a second vertical wall 228 having a notch 230, and a transverse wall 232 connecting the first vertical wall 224 and the second vertical wall 228.

The seat assembly 30 also includes a pair of couplings 235 having an elongated shape and including two protrusions 237, and two buttons 240, each adapted to be received in one corresponding recess 204 in the seat housing 200. The couplings 237 are supported by the first retainer 218 and the second retainer 220. More specifically, the receiving aperture 225 and the notch 230 support the protrusions 237 of the couplings 237. Accordingly, each of the couplings 237 couples to one corresponding coupling end 210 of the frame 208 extending through the recess 202, and cooperates with the buttons 240 to support and/or adjust the position of the frame 208.

The seat assembly 30 also includes a pair of rails 245 (only one shown in FIG. 10) positioned at opposite sides of the seat housing 200, and adapted to support a pair of wheels 248. The wheels 248 (three shown in FIG. 10) allow the seat assembly 30 to glide in a forward-and-backward motion, as will be further explained.

The exercise device 10 includes the seat pad assembly 35 supported by the seat assembly 30. FIG. 11 illustrates the seat pad assembly 35 including two TC print feet appliqués 300, a nylon mesh kick panel 305, two pieces 310 of about 0.5 inches of batting, two pieces 315 of plush feet appliqués, a woven seat inner panel 320, a woven seat outer panel 325, a layer 330 with about one inch of batting, for example, a seat lining 335, a woven seat back inner panel 340, a layer 345 with about one inch of batting, for example, a seat back lining 350, a two-sided knit (foam laminated) 355, a second two-sided knit (foam laminated) 360, a casing 365 for the frame 208, a stretch terry bolster cover 370, a stretch terry removable pad 375, a layer 380 with one inch of batting, for example, a removable pad lining 385, and a fiberfill bolster filling 390. It is to be understood that a different seat pad materials, appliqués, thicknesses of materials also fall within the scope of the invention.

Figure 12:
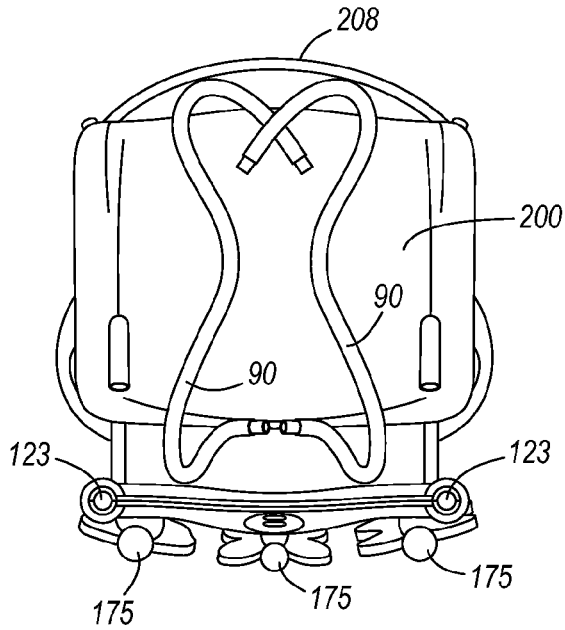
FIG. 12 is a top view of a disassembled child exercise device as packaged.
Figure 13:
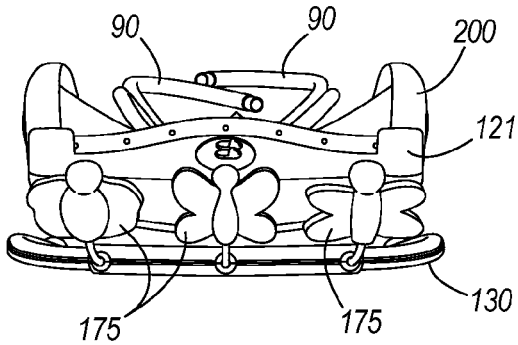
FIG. 13 is a front view of the disassembled child exercise device as packaged.
Figure 14:
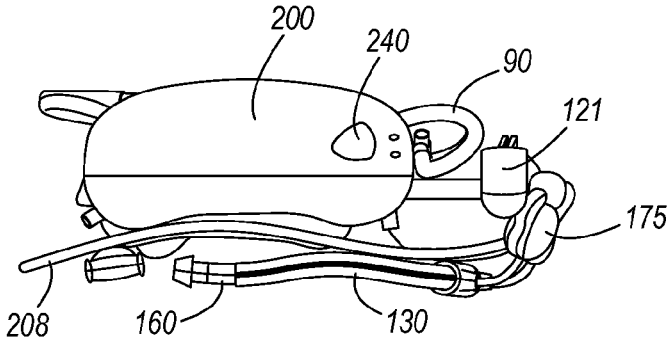
FIG. 14 is a side view of the disassembled child exercise device as packaged.

FIGS. 12-14 illustrate the exercise device 10 in a partially disassembled mode such that the exercise device 10 is ready for packaging and/or shipping. It is possible to observe that in the configuration shown in FIGS. 12-14, the overall dimensions of the exercise device 10 are reduced from a fully assembled mode (FIGS. 2-5) to the partially disassembled mode. To transform the exercise device 10 from the fully assembled mode to the partially disassembled mode, a user can disengage the frame 208 from the recesses 202, the support legs 90 from the lateral compartments 44, and the U-shaped frame assembly 133 from the ports 121 and the clamped curved portions 190. The user can then proceed to place the frame 208 and the U-shaped frame assembly 133 beneath the base assembly 15, and the support legs 90 on the seat housing 200. It is to be understood that other partially disassembled modes are possible and fall within the scope of the invention.

Figure 15:
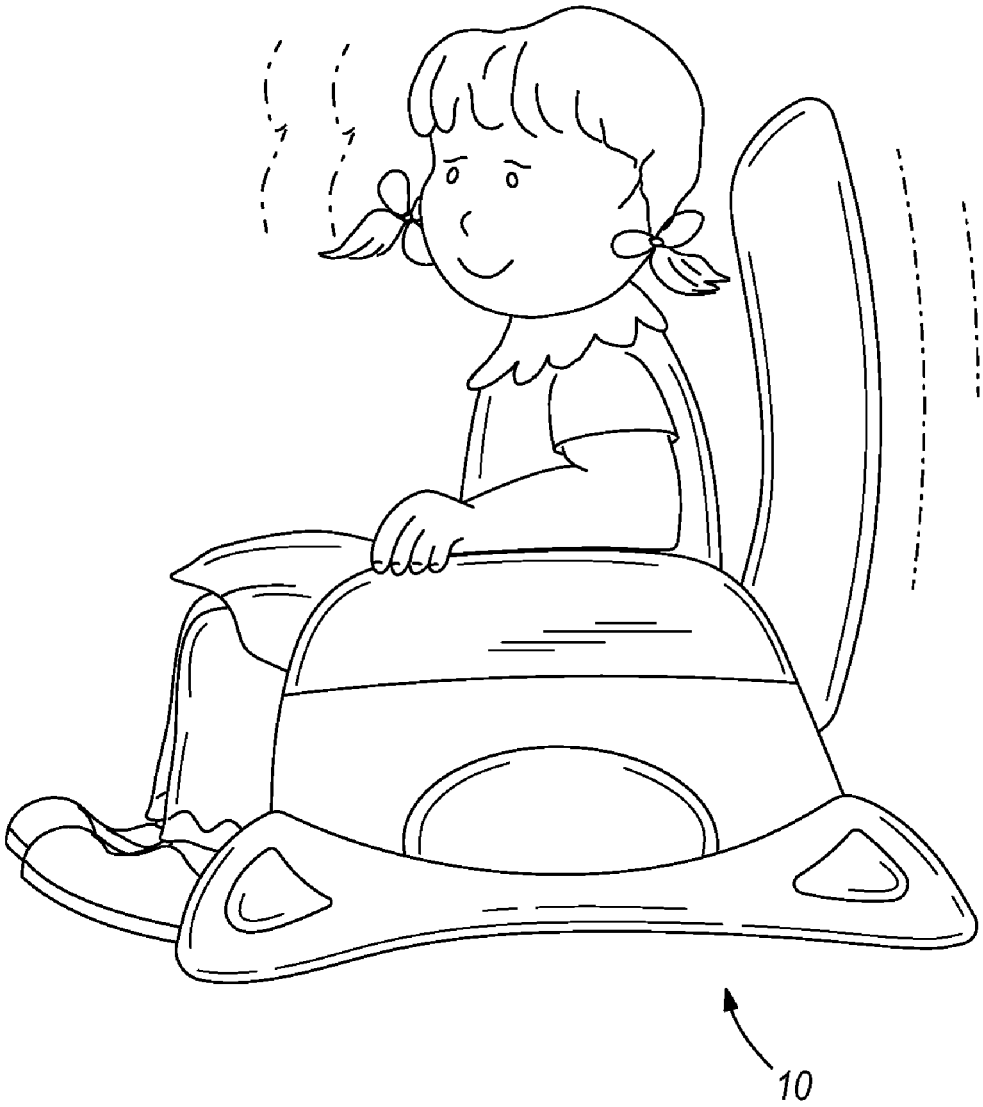
FIG. 15 is a perspective view of glider chair according to another embodiment of the present invention.

With reference to FIGS. 1 and 15, the exercise device 10 can be modified from the exercise mode (shown for example in FIG. 1) to a glider chair as shown in FIG. 15. To convert or modify the exercise device 10 to the toddler glider chair (exercise device in toddler mode), the recline position of the frame 208 of the seat assembly 30 can be adjusted to the desired position, and the kick bar assembly 25 can be removed from the exercise device 10. The recline position of the frame 208 is adjusted with buttons 240.

The embodiments described above and illustrated in the figures are presented by way of example only and are not intended as a limitation upon the concepts and principles of the present invention. As such, it will be appreciated by one having ordinary skill in the art that various changes in the elements and their configuration and arrangement are possible without departing from the spirit and scope of the present invention.

What is claimed is:

1. A child exercise device comprising:

a base assembly including a housing, and a plurality of tracks oriented substantially parallel to each other;

a kick panel support assembly supported by the base, the kick panel support assembly including a plate coupled to the housing, and a front panel coupled to the plate, the front panel having a plurality of apertures;

a kick panel assembly received by the plurality of apertures, the kick panel assembly including a frame, and a panel supported by the frame; and a seat assembly including a seat adapted to support the child, and a plurality of wheels coupled to the seat and adapted to be received in one of the tracks in the base.

2. The child exercise device of claim 1 wherein the seat is adapted to glide along a path defined by the track in the base when a force is exerted on the panel by the child.

3. The child exercise device of claim 2 wherein the seat glides in a first direction and wherein the force is in a direction opposite to the first direction.

4. The child exercise device of claim 1 wherein the panel is oriented substantially perpendicular with respect to the plate of the kick panel support assembly.

5. The child exercise device of claim 1 wherein the seat includes a housing and a frame supported by the housing, the frame forming a backrest, and wherein the frame is oriented at an angle with respect to the housing.

6. The child exercise device of claim 5 wherein the angle of the frame with respect to the housing is obtuse.

7. The child exercise device of claim 1 wherein the kick panel support assembly further comprises a housing coupled to an underside surface of the plate, the housing adapted to support a power source and a motor.

8. The child exercise device of claim 7 wherein the motor is adapted to impart vibration to the seat assembly when a force is applied to the panel.

9. The child exercise device of claim 7 wherein the kick panel assembly includes a light source powered by the power source, and wherein the light source is activated when a force is applied to the panel.

10. The child exercise device of claim 1 wherein the base includes a plurality of legs coupled to an underside surface of the housing.

11. A child exercise device comprising:

a seat adapted to support the child;

a base adapted to support the seat, the seat adapted to move with respect to the base;

a first assembly including a first portion coupled to the base and positioned between a bottom portion of the seat and an upper portion of the base, and a second portion extending from the first portion; and a second assembly coupled to the second portion of the first assembly, the second assembly oriented substantially perpendicular to the first portion of the first assembly wherein the seat is adapted to glide along a path defined by a track in the base when a force is exerted on the second assembly by the child.

12. The child exercise device of claim 11 wherein the seat glides in a first direction and wherein the force is in a direction opposite to the first direction.

13. A child exercise device comprising:

a seat adapted to support the child;

a base adapted to support the seat, the seat adapted to move with respect to the base;

a first assembly including a first portion coupled to the base and positioned between a bottom portion of the seat and an upper portion of the base, and a second portion extending from the first portion; and a second assembly coupled to the second portion of the first assembly, the second assembly oriented substantially perpendicular to the first portion of the first assembly wherein the seat includes a housing and a frame supported by the housing, the frame forming a backrest, and wherein the frame is oriented at an angle with respect to the housing.

14. The child exercise device of claim 13 wherein the angle of the frame with respect to the housing is obtuse.

15. The child exercise device of claim 11 wherein the first assembly further comprises a housing coupled to an underside surface of the first portion, the housing adapted to support a power source and a motor.

16. The child exercise device of claim 15 wherein the motor is adapted to impart vibration to the seat when a force is applied to the second assembly.

17. The child exercise device of claim 16 wherein the second assembly includes a light source powered by the power source, and wherein the light source is activated when a force is applied to the second assembly.

18. The child exercise device of claim 11 further comprising a plurality of legs coupled to an underside surface of the base.

* * * * *